US008732972B2

(12) United States Patent
Jordan

(10) Patent No.: US 8,732,972 B2
(45) Date of Patent: May 27, 2014

(54) FRAMING TOOL

(76) Inventor: Garland R. Jordan, Atlanta, GA (US)

( * ) Notice: Subject to any disclaimer, the term of this patent is extended or adjusted under 35 U.S.C. 154(b) by 220 days.

(21) Appl. No.: 13/403,547

(22) Filed: Feb. 23, 2012

(65) Prior Publication Data

US 2013/0219732 A1 Aug. 29, 2013

(51) Int. Cl.
*G01B 5/16* (2006.01)

(52) U.S. Cl.
USPC ..... 33/613; 33/334; 33/347

(58) Field of Classification Search
USPC ..... 33/613, 333, 334, 347, 451, DIG. 1, 33/647, 649, 526, 527
See application file for complete search history.

(56) References Cited

U.S. PATENT DOCUMENTS 1,639,580 A * 8/1927 Thompson ..... 33/437
3,213,545 A * 10/1965 Wright ..... 33/347
4,625,415 A * 12/1986 Diamontis ..... 33/613
5,163,233 A * 11/1992 Benson ..... 33/613
5,367,783 A * 11/1994 Nygren ..... 33/613
6,070,336 A * 6/2000 Rodgers ..... 33/613
6,568,095 B2 * 5/2003 Snyder ..... 33/370
6,895,684 B1 * 5/2005 Firth ..... 33/613
6,935,041 B2 * 8/2005 Orton ..... 33/613
7,552,540 B2 * 6/2009 Ming ..... 33/347
8,191,335 B2 * 6/2012 Davis ..... 52/749.1
8,286,360 B1 * 10/2012 Murray et al. ..... 33/347
2010/0155565 A1 * 6/2010 Bernstein ..... 248/467

* cited by examiner

*Primary Examiner* — Christopher Fulton

(74) *Attorney, Agent, or Firm* — Gonzalez Saggio & Harlan LLP

(57) ABSTRACT

Different advantageous embodiments provide an apparatus comprising a plurality of frame guides positioned along a base. Each of the plurality of frame guides is substantially configured to provide a ninety degree angle with the base on at least one side of the each of the plurality of frame guides. One or more coupling mechanisms are secured to the base.

20 Claims, 11 Drawing Sheets

FRAMING TOOL

BACKGROUND

In the construction industry, framing is a building technique by which a frame of rigid elements is constructed for a building. Exterior and interior wall elements, roof and ceiling elements, windows, doorways, and other elements of the structure are then attached to the frame according to the specifications for the building.

Cold form metal framing is one method of framing used widely in commercial construction, and increasingly in residential construction as well. Light gauge metal studs are used in the framing of a structure. Wall sections usually include a metal track secured to the structure of the floor, and often a corresponding metal track for the top of the wall secured to a structure of the ceiling, such as a joist or rafter. Studs are implemented in these metal tracks to form a frame for the wall section.

Building specifications generally specify placement of studs, such as for a wall section, with set increments of space between each stud. These increments must be measured out fairly accurately, typically using a tape measure, to ensure accurate installation of the studs for a wall section in a framing project. Additionally, each stud needs to be squared, leveled, and fastened into the floor and ceiling.

Therefore, it is desirable to have a tool that addresses one or more of the issues discussed above in order to provide an efficient solution for accurately framing a structure.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Briefly, various aspects of the subject matter described herein are directed towards an apparatus comprising a plurality of frame guides positioned along a base. Each of the plurality of frame guides is substantially configured to provide a ninety degree angle with the base on at least one side of the each of the plurality of frame guides. One or more coupling mechanisms are secured to the base.

Another aspect is directed towards a method for stud placement in framing. A plurality of frame guides is positioned along a base of a framing tool. The plurality of frame guides is secured to the base of the framing tool. At least one level tool is secured to at least one frame guide in the plurality of frame guides.

Yet another aspect is directed towards a framing tool comprising a plurality of frame guides positioned along a base. Each of the plurality of frame guides is substantially configured to provide a ninety degree angle on at least one side of the each of the plurality of frame guides. A first coupling mechanism is secured along a bottom portion of the base. A second coupling mechanism is secured along a top portion of the base. At least one level tool is secured to at least one frame guide of the plurality of frame guides.

Other advantages may become apparent from the following detailed description when taken in conjunction with the drawings.

BRIEF DESCRIPTION OF THE DRAWINGS

The present invention is illustrated by way of example and not limited in the accompanying figures, in which like reference numerals indicate similar elements. The advantageous embodiments, as well as a preferred mode of use, further objectives and advantages thereof, will best be understood by reference to the following detailed description of an advantageous embodiment of the present disclosure when read in conjunction with the accompanying drawings, wherein.

DETAILED DESCRIPTION

Figure 1:
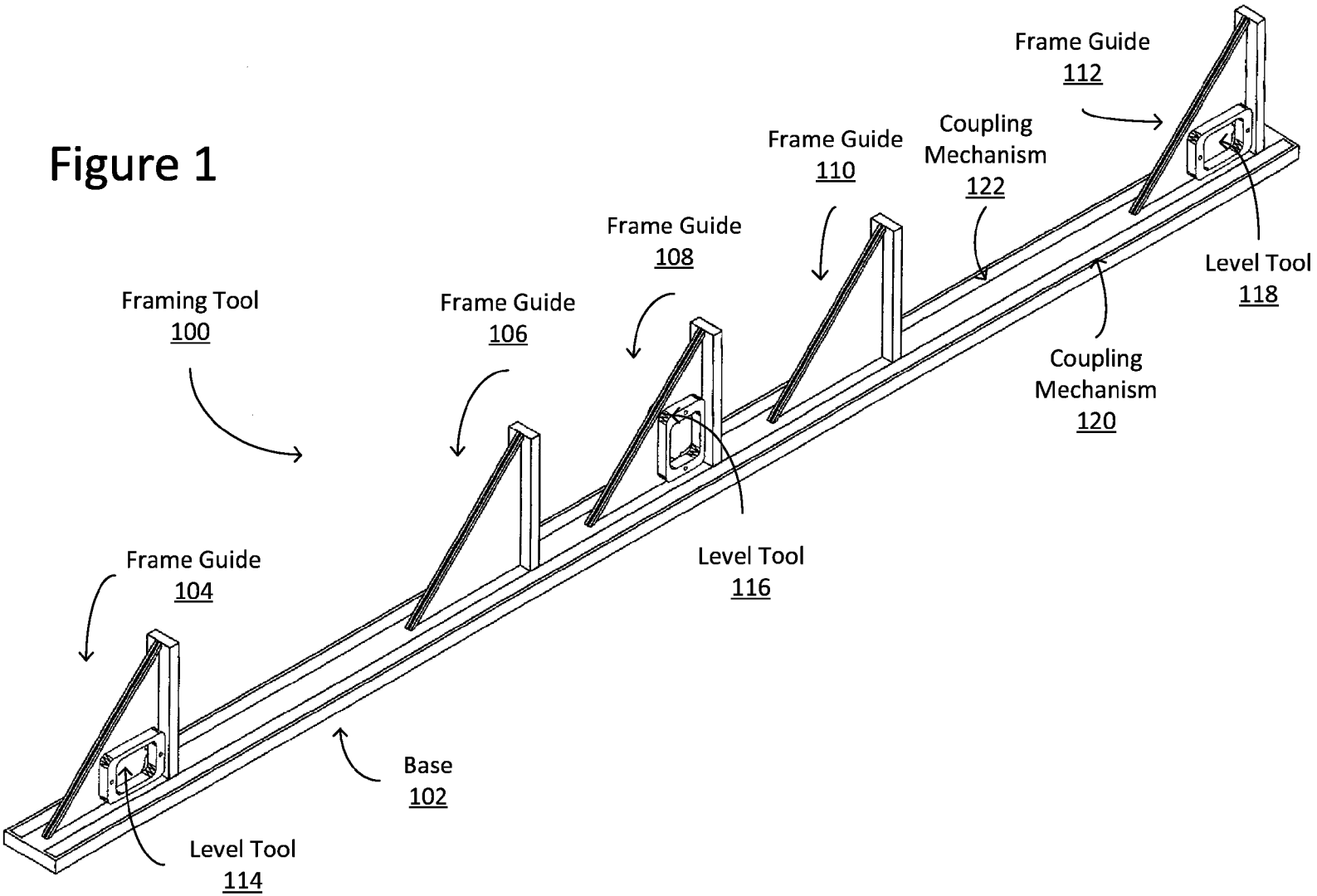
FIG. 1 is an illustrative example of a framing tool in accordance with an advantageous example embodiment.

Various aspects of the technology described herein are generally directed towards a tool and method for framing a structure. As will be understood, the technology described herein is not limited to any type of environment or subject for framing a structure. As such, the present invention is not limited to any particular embodiments, aspects, concepts, protocols, structures, functionalities or examples described herein. Rather, any of the embodiments, aspects, concepts, protocols, structures, functionalities or examples described herein are non-limiting, and the present invention may be used in various ways that provide benefits and advantages in framing in general.

As used herein, the phrase "at least one of", when used with a list of items, means that different combinations of one or more of the items may be used and only one of each item in the list may be needed. For example, "at least one of item A, item B, and item C" may include, for example, without limitation, item A or item A and item B. This example also may include item A, item B, and item C or item B and item C.

The different advantageous embodiments recognize and take into account that current methods for framing in construction require multiple tools and human workers to secure each individual stud. A stud may be placed in a position along a wall section using a tape measure to determine the appropriate placement. Another tool may be used to plumb the stud as it is being positioned. A framing square may be used to square the stud with the track of the particular section. A framing clamp may be used to secure the stud in the position determined with the tape measure, the plumb tool, and the framing square while the stud is being fastened or affixed to the track for that section. This process is repeated for each stud placed in that section of the frame.

Thus, various aspects of the subject matter described herein are directed towards an apparatus comprising a plurality of frame guides positioned along a base. Each of the plurality of frame guides is substantially configured to provide a ninety degree angle with the base on at least one side of the each of the plurality of frame guides. One or more coupling mechanisms are secured to the base.

Another aspect is directed towards a method for stud placement in framing. A plurality of frame guides is positioned along a base of a framing tool. The plurality of frame guides is secured to the base of the framing tool. At least one level tool is secured to at least one frame guide in the plurality of frame guides.

Yet another aspect is directed towards a framing tool comprising a plurality of frame guides positioned along a base. Each of the plurality of frame guides is substantially configured to provide a ninety degree angle on at least one side of the each of the plurality of frame guides. A first coupling mechanism is secured along a bottom portion of the base. A second coupling mechanism is secured along a top portion of the base. At least one level tool is secured to at least one frame guide of the plurality of frame guides.

With reference now to FIG. 1, an illustration of a framing tool is depicted in which an advantageous example embodiment may be implemented. FIG. 1 depicts a perspective view of the back and side of a framing tool 100.

The framing tool 100 is configured to provide guidance and alignment for placement of multiple construction materials in a framing project. The construction materials may include materials such as, without limitation, studs, door frames, window frames, metal tracks, joists, rafters, panels, I-beams, columns, rebar, decking, trusses, channels, railings, posts, beams, and/or any other suitable construction material. In one advantageous embodiment, the framing tool 100 may be used to place metal studs in a cold form metal framing project, for example.

The framing tool 100 may be constructed out of a durable, lightweight, and rigid material, such as, without limitation, aluminum, for example. The framing tool 100 includes a base 102, and a plurality of frame guides. The frame guides are elements of the framing tool 100 that are affixed to the base 102 in such a way as to provide a ninety degree angle on at least one side of a frame guide, where the frame guides meet the base 102. In one advantageous embodiment, the framing tool 100 includes a frame guide 104, a frame guide 106, a frame guide 108, a frame guide 110, and a frame guide 112. In other advantageous embodiments, the framing tool 100 may include additional frame guides and/or fewer frame guides, for example.

Optionally, the frame guides may include embedded tools, such as a level tool, a plumb tool, and or any other suitable tool for framing a structure. In this illustrative example, the frame guide 104 includes a level tool 114, the frame guide 108 includes a level tool 116, and the frame guide 112 includes a level tool 118. In one advantageous embodiment, the level tool 114 and the level tool 118 may be used to plumb a stud, such as when the framing tool 100 is placed in a vertical position against a wall stud, for example. In another advantageous embodiment, the level tool 116 may be used to level a horizontal element of a framing structure, such as a door frame, for example.

In one advantageous implementation, the framing tool 100 further includes coupling mechanisms, such as, without limitation, a coupling mechanism 120 and a coupling mechanism 122. The coupling mechanism 120 and the coupling mechanism 122 may be, for example, without limitation, magnetic strips. The coupling mechanism 120 and the coupling mechanism 122 may be implemented along the length of the top of the framing tool 100, along either side of the frame guides. The coupling mechanism 120 and the coupling mechanism 122 may be used to couple, or temporarily secure, the framing tool 100 to a track along a portion of a structure to be framed, such as a wall section, for example. The coupling mechanism 120 and the coupling mechanism 122 may be inset into the base 102 in order to be flush with the top of the base 102, in one advantageous embodiment.

In an illustrative embodiment, the framing tool 100 may be used in a vertical alignment to plumb a first stud in a framing project for a structure, for example. The first stud may be set into a metal track along the floor and/or ceiling, for example, for a wall section of a structure. The framing tool 100 may be coupled to the first stud, such as through magnetic coupling for example, where the bottom of the base 102 is disposed along the vertical length of the first stud, in order to plumb the first stud, in this illustrative embodiment.

After the first stud is plumbed, the framing tool 100 may be placed perpendicular to the first stud, horizontal with the floor or ceiling for example, and the coupling mechanism 120 and the coupling mechanism 122 may temporarily secure the framing tool 100 to the track in order to provide guidance for stud placement and alignment. The framing tool 100 may then provide a guideline for the placement of the next several studs, with the appropriate increments of space between each stud provided by the frame guides of the framing tool 100.

The illustration of the framing tool 100 in FIG. 1 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

For example, in some advantageous embodiments, additional coupling mechanisms may be disposed along one or more portions of the frame guides and/or along one or more portion of the base 102, such as a bottom portion of the base 102, in one illustrative implementation. In other advantageous embodiments, the framing tool 100 may be used to position and align construction materials other than a stud, such as, without limitation, a door frame or ceiling joist, for example.

Figure 2:
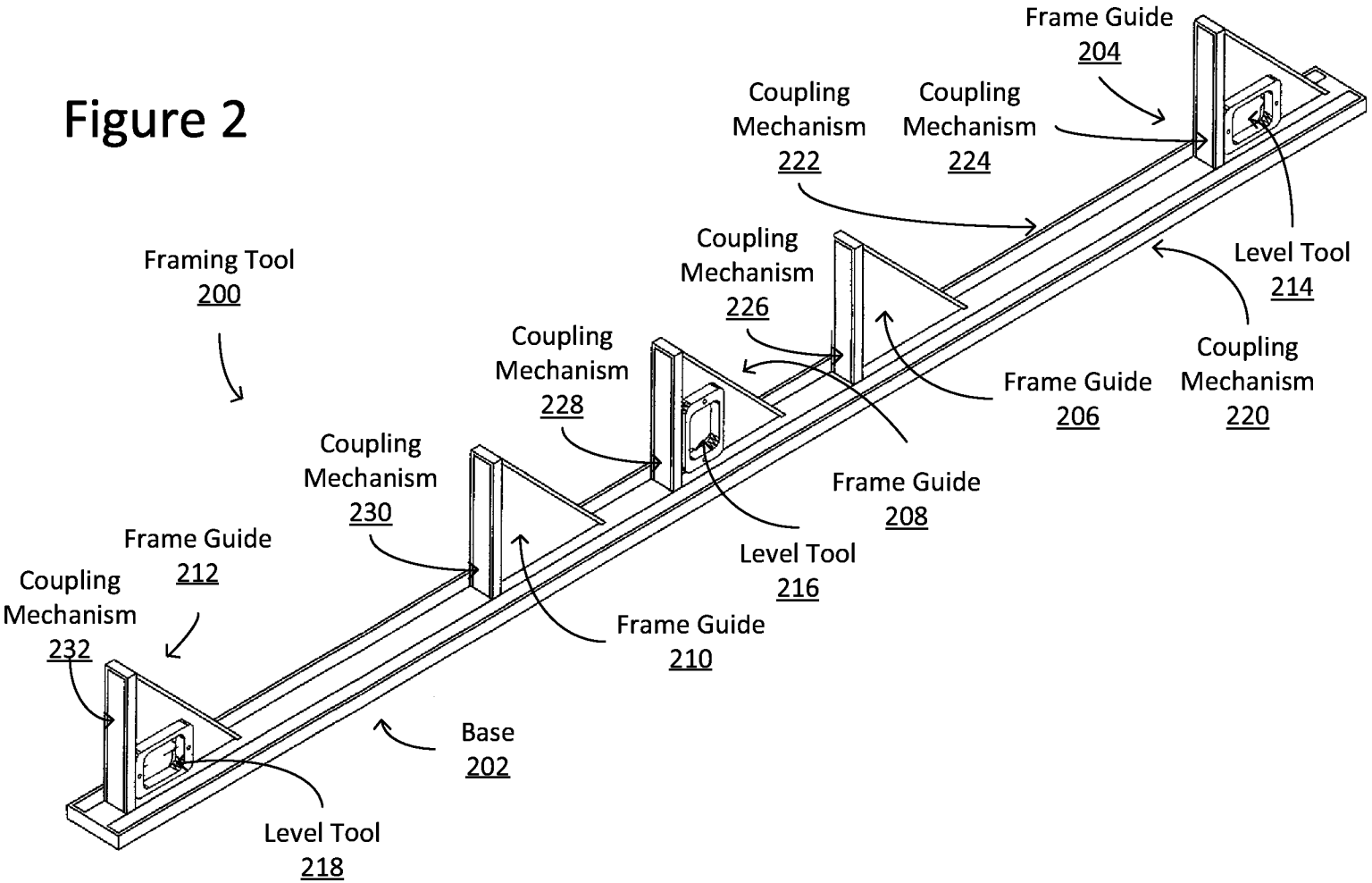
FIG. 2 is an illustrative example of a framing tool in accordance with an advantageous example embodiment.

With reference now to FIG. 2, an illustration of a framing tool is depicted in which an advantageous example embodiment may be implemented. FIG. 2 depicts a perspective view of the front and side of a framing tool 200. The framing tool 200 may be an illustrative implementation of the framing tool 100, viewed from a different perspective, for example.

The framing tool 200 includes a base 202, a frame guide 204, a frame guide 206, a frame guide 208, a frame guide 210, and a frame guide 212. Optionally, the frame guide 204 may include a level tool 214, the frame guide 208 may include a level tool 216, and the frame guide 212 may include a level tool 218. The level tool 214 and the level tool 218 may be illustrative implementations of the level tool 114 and the level tool 118 in FIG. 1, for example. The level tool 216 may be an illustrative implementation of the level tool 116 in FIG. 1, for example.

The framing tool 200 further includes a coupling mechanism 220 and a coupling mechanism 222. The coupling mechanism 220 and the coupling mechanism 222 may be one illustrative implementation of the coupling mechanism 120 and the coupling mechanism 122 in FIG. 1, for example. The coupling mechanism 220 and the coupling mechanism 222 are implemented along the length of the top of the framing tool 200, along either side of the frame guides. The coupling mechanism 220 and the coupling mechanism 222 may be used to temporarily secure the framing tool 200 to a construction material, such as a track along a portion of a structure to be framed, for example. In one illustrative example, where coupling mechanism 220 and the coupling mechanism 222 are implemented as magnetic strips, the track along a portion of the structure to be framed may be a metal track for a wall section.

The framing tool 200 further includes a coupling mechanism 224 secured along a side of the frame guide 204. The coupling mechanism 224 is secured along at least one side at which the frame guide 204 is affixed to the base 202 to form a ninety degree angle. Likewise, a coupling mechanism 226 is secured along a side of the frame guide 206, a coupling mechanism 228 is secured along a side of the frame guide 208, a coupling mechanism 230 is secured along a side of the frame guide 210, and a coupling mechanism 232 is secured along a side of the frame guide 212. The coupling mechanisms 224, 226, 228, 230, and 232 each provide a temporary, secure connection between the frame guides 204, 206, 208, 210, and 212, and the one or more construction elements, such as one or more studs for example, placed along the frame guides for framing.

Additionally, in one illustrative embodiment where the construction material being aligned is a metal stud, placing the closed side of a metal stud to a coupling mechanism on a frame guide, such as the coupling mechanism 224 along the frame guide 204, assures that the open side of the metal stud is facing in the correct layout position for framing a wall section, for example.

In one advantageous embodiment, the studs placed along the frame guides may be metal studs and the coupling mechanisms 224, 226, 228, 230, and 232 secured along a side of the frame guides 204, 206, 208, 210, and 212 may be magnetic strips. In this illustrative example, the magnetic attraction provided by the magnetic strips of the framing tool 200 connects the framing tool 200 to both the metal studs and the metal track. This illustrative coupling provides for alignment of multiple studs at one time.

The illustration of the framing tool 200 in FIG. 2 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 3:
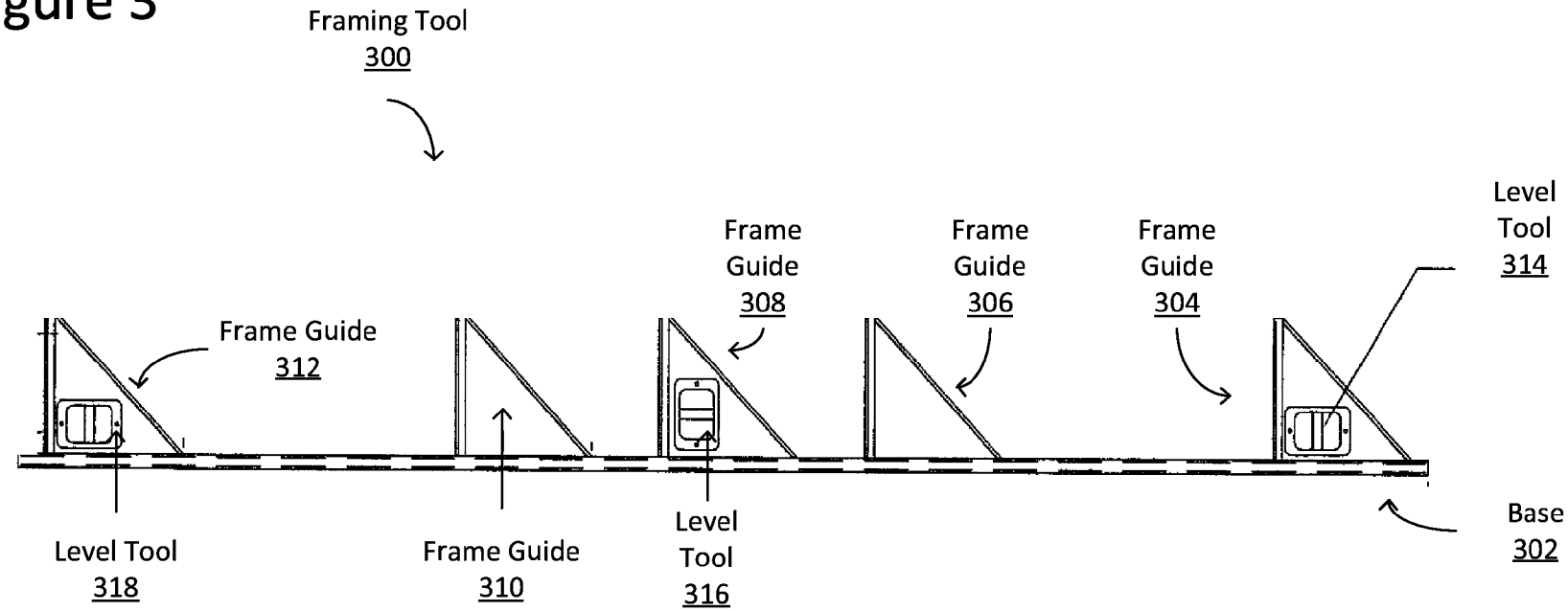
FIG. 3 is an illustrative example of a framing tool in accordance with an advantageous example embodiment.

With reference now to FIG. 3, an illustration of a framing tool is depicted in which an advantageous example embodiment may be implemented. FIG. 3 depicts a side view of a framing tool 300.

The framing tool 300 includes a base 302, a frame guide 304, a frame guide 306, a frame guide 308, a frame guide 310, and a frame guide 312. Optionally, the frame guide 304 may include a level tool 314, the frame guide 308 may include a level tool 316, and the frame guide 312 may include a level tool 318. The level tool 314 and the level tool 318 may be illustrative implementations of the level tool 114 and the level tool 118 in FIG. 1, for example. The level tool 316 may be an illustrative implementation of the level tool 116 in FIG. 1, for example.

There are a number of commonly used spacing dimensions between construction materials in framing specifications. These spacing dimensions may include, for example, without limitation, studs placed with a distance of sixteen inches between each stud, studs placed with a distance of twenty-four inches between each stud, and/or any other suitable distance set out in the building specifications for various construction materials. In one illustrative embodiment, the base 302 may be configured at a length of four feet and seven inches.

In an advantageous embodiment, the framing tool 300 may include frame guides for providing spacing of both the twenty-four inch specification and the sixteen inch specification, for placement of wall studs. In this illustrative example, the frame guide 304, the frame guide 308, and the frame guide 312 are each configured to provide a spacing of twenty-four inches between studs, when studs are aligned with each of the frame guide 304, the frame guide 308, and the frame guide 312. The frame guide 304, the frame guide 306, the frame guide 310, and the frame guide 312 are each configured to provide a spacing of sixteen inches between studs, when studs are aligned with each of the frame guide 304, the frame guide 306, the frame guide 310, and the frame guide 312, in this illustrative example.

The illustration of the framing tool 300 in FIG. 3 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

For example, different configurations and specifications may be used to align construction materials other than studs in a construction project. The frame guides may be implemented in any configuration and spacing for providing alignment guidance for the placement of construction materials.

Figure 4:
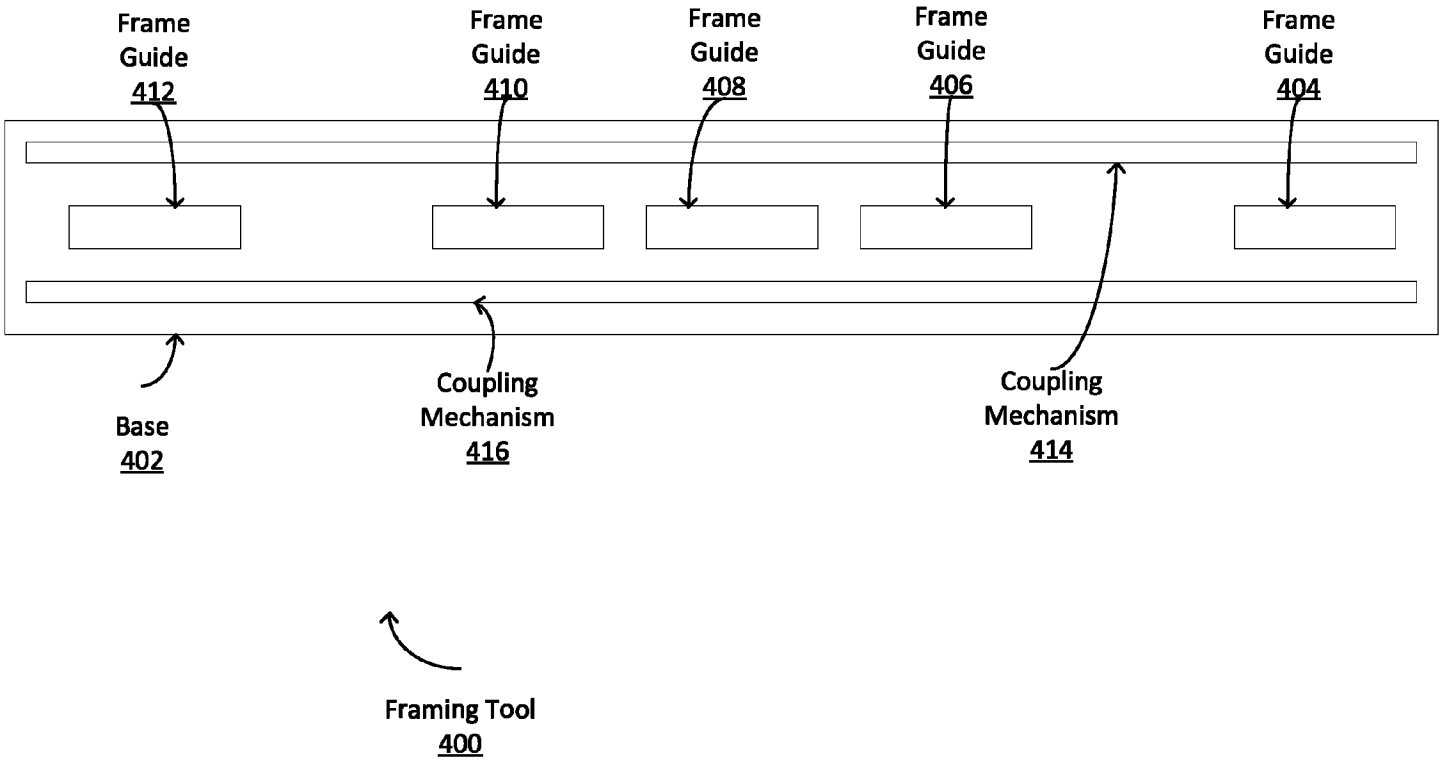
FIG. 4 is an illustrative example of a framing tool in accordance with an advantageous example embodiment.

With reference now to FIG. 4, an illustration of a framing tool is depicted in which an advantageous example embodiment may be implemented. FIG. 4 depicts a top view of a framing tool 400.

The framing tool 400 includes a base 402, a frame guide 404, a frame guide 406, a frame guide 408, a frame guide 410, and a frame guide 412. A coupling mechanism 414 and a coupling mechanism 416 are secured along the length of the base 402, on either side of the frame guide 404, the frame guide 406, the frame guide 408, the frame guide 410, and the frame guide 412. The coupling mechanism 414 and the coupling mechanism 416 may be an illustrative implementation of the coupling mechanism 120 and the coupling mechanism 122 in FIG. 1, for example.

The illustration of the framing tool 400 in FIG. 4 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 5:
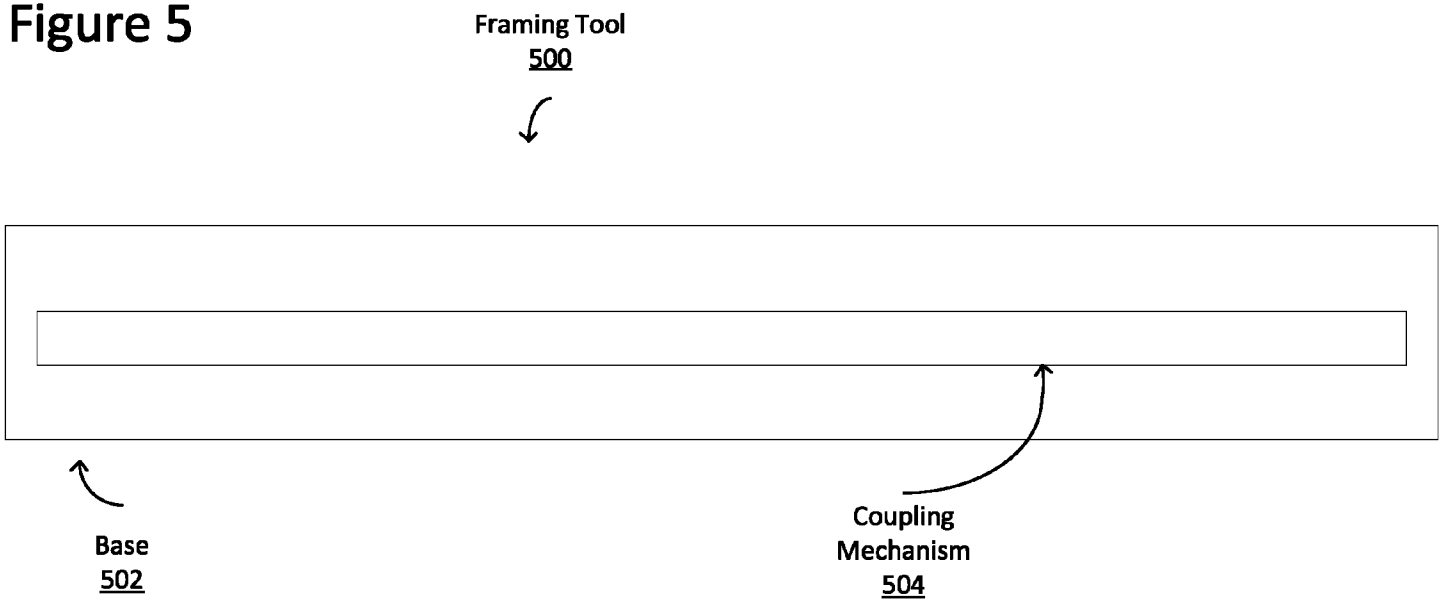
FIG. 5 is an illustrative example of a framing tool in accordance with an advantageous example embodiment.

With reference now to FIG. 5, an illustration of a framing tool is depicted in which an advantageous example embodiment may be implemented. FIG. 5 depicts a bottom view of a framing tool 500.

The framing tool 500 includes a base 502 and a coupling mechanism 504. The coupling mechanism 504 is disposed along the length of the base 502, on the bottom portion of the framing tool 500. The coupling mechanism 504 may be, for example, without limitation, one or more magnetic strips. In one advantageous embodiment, the coupling mechanism 504 may provide a magnetic connection between the framing tool 500 and a construction material, such as when the framing tool 500 is placed vertically along the length of a metal stud to plumb the stud, for example. The coupling mechanism 504 may be inset into the base 502 in order to be flush with the bottom of the base 502, in one advantageous embodiment.

The illustration of the framing tool 500 in FIG. 5 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 6:
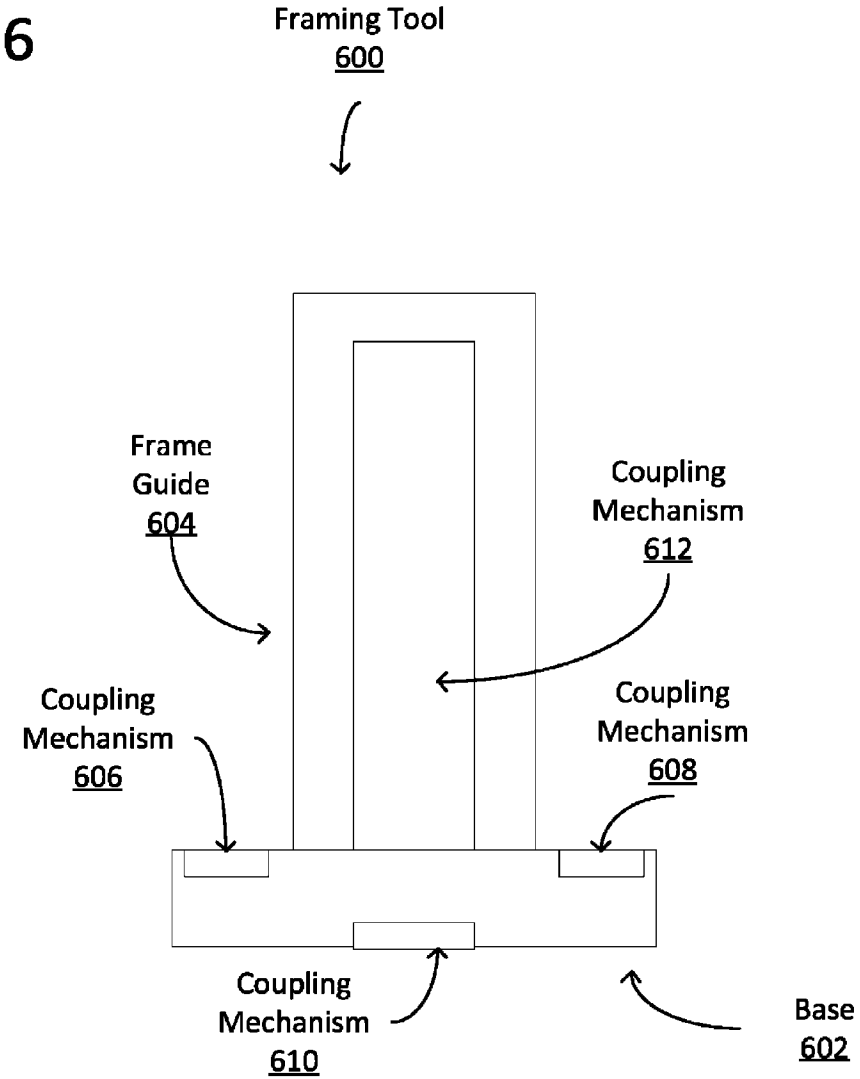
FIG. 6 is an illustrative example of a framing tool in accordance with an advantageous example embodiment.

With reference now to FIG. 6, an illustration of a framing tool is depicted in which an advantageous example embodiment may be implemented. FIG. 6 depicts a front view of a framing tool 600, and more specifically a single frame guide at the front of the framing tool 600.

The framing tool 600 includes a base 602, a frame guide 604, a coupling mechanism 606, a coupling mechanism 608, a coupling mechanism 610, and a coupling mechanism 612. The coupling mechanism 606 and the coupling mechanism 608 are implemented along the top of the framing tool 600 and may provide a temporary, secure connection between the framing tool 600 and one or more construction materials, such as a metal track, for example. The coupling mechanism 610 is implemented along the bottom of the framing tool 600 and may provide a temporary, secure connection between the framing tool 600 and one or more construction materials, such as a metal stud, for example. The coupling mechanism 612 is implemented along the front of the frame guide 604 and may provide a temporary, secure connection between the framing tool 600 and one or more construction materials, such as metal stud, for example.

The illustration of the framing tool 600 in FIG. 6 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 7:
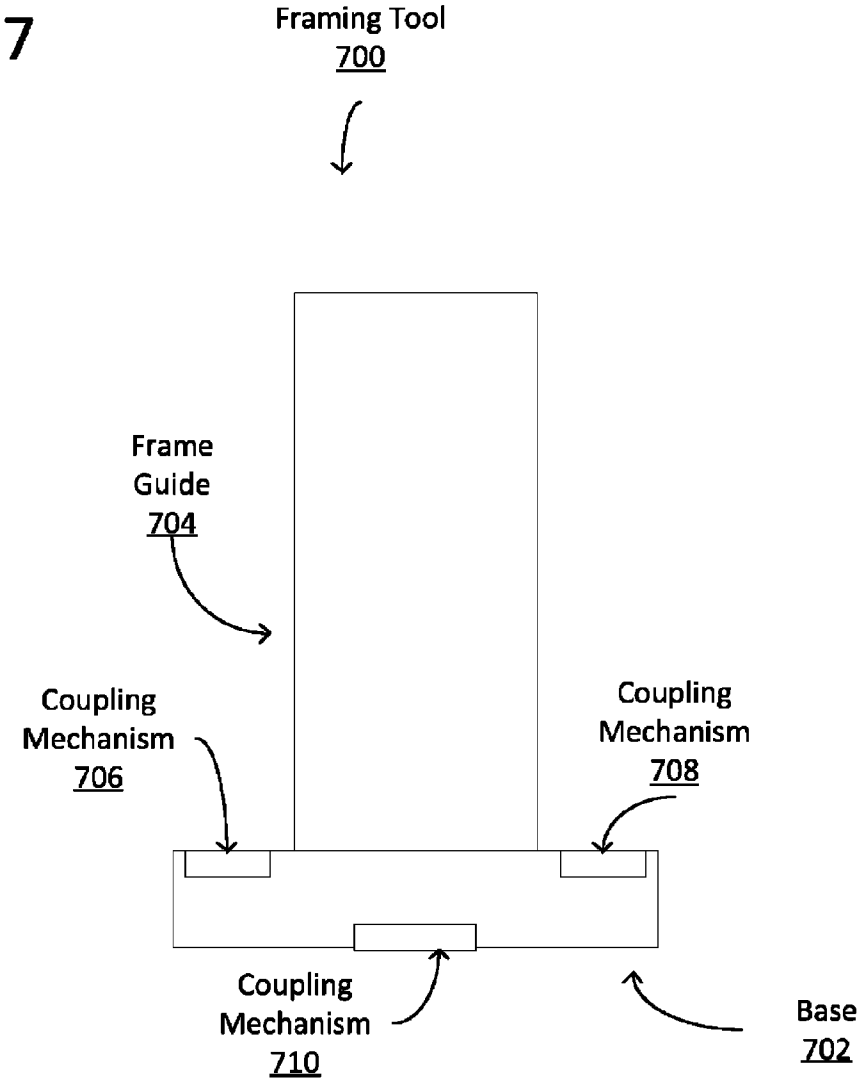
FIG. 7 is an illustrative example of a framing tool in accordance with an advantageous example embodiment.

With reference now to FIG. 7, an illustration of a framing tool is depicted in which an advantageous example embodiment may be implemented. FIG. 7 depicts a rear view of a framing tool 700.

The framing tool 700 includes a base 702, a frame guide 704, a coupling mechanism 706, a coupling mechanism 708, and a coupling mechanism 710. The coupling mechanism 706 and the coupling mechanism 708 are implemented along the top of the framing tool 700 and may provide a temporary, secure connection between the framing tool 700 and one or more construction materials, such as a metal track, for example. The coupling mechanism 710 is implemented along the bottom of the framing tool 700 and may provide a temporary, secure connection between the framing tool 700 and one or more construction materials, such as a stud or other framing element, for example.

The illustration of the framing tool 700 in FIG. 7 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 8:
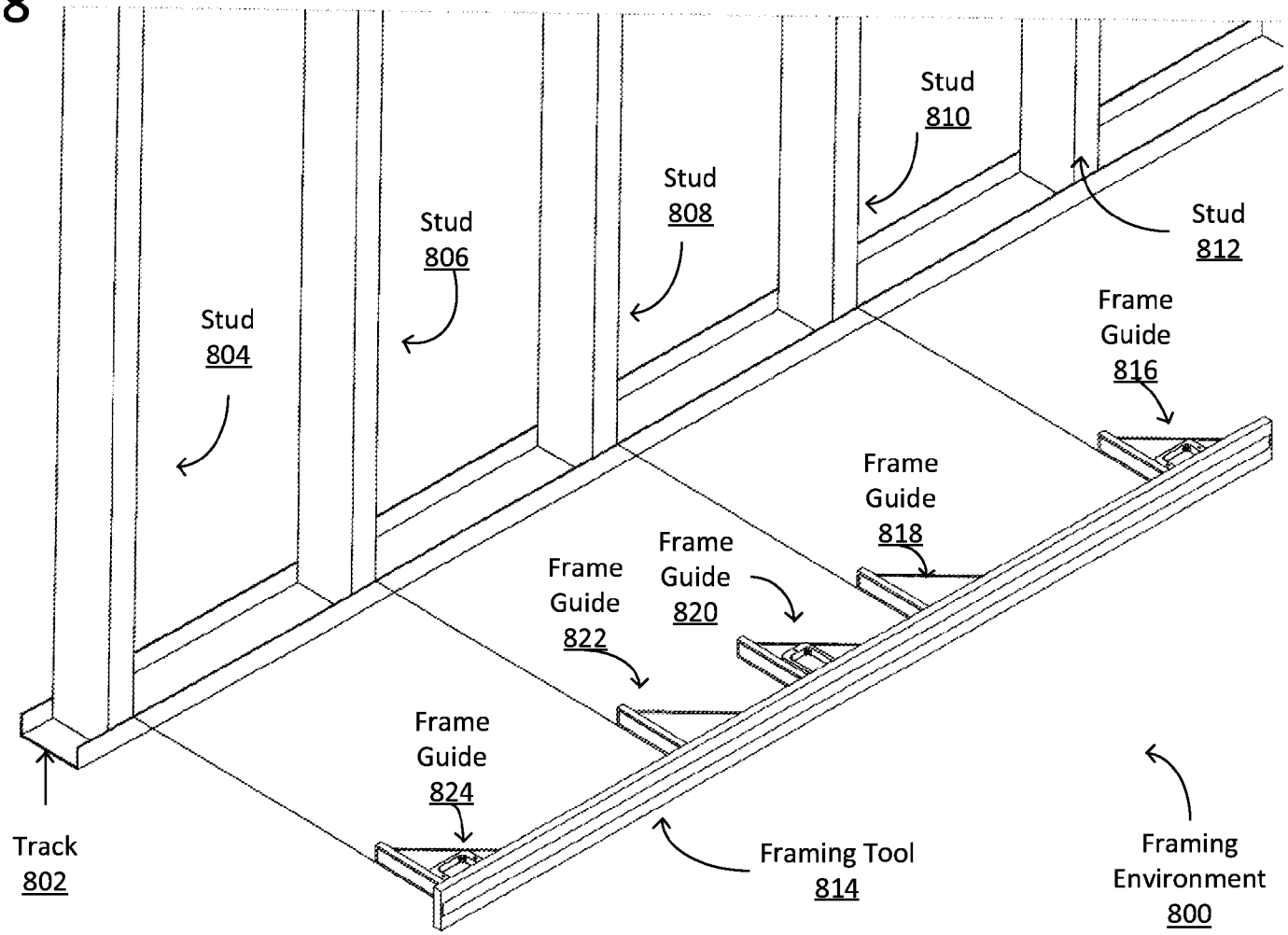
FIG. 8 is an illustrative example of a framing environment in accordance with an advantageous example embodiment.

With reference now to FIG. 8, an illustration of a framing environment is depicted in which an advantageous example embodiment may be implemented. The framing environment 800 may include an implementation of a framing tool, such as the framing tool 100 in FIG. 1, for example.

The framing environment 800 includes a track 802. The track 802 may be, without limitation, a metal plate or metal tray used along the bottom and/or top of a wall section, for example. A stud 804, a stud 806, a stud 808, a stud 810, and a stud 812 may be aligned and affixed to the track 802 using the framing tool 814, in an illustrative example. In one illustrative example, the stud 804, the stud 806, the stud 808, the stud 810, and the stud 812 may be metal studs.

The framing tool 814 includes a frame guide 816, a frame guide 818, a frame guide 820, a frame guide 822, and a frame guide 824. In this illustrative example, the specifications for the framing environment 800 may require studs to be placed at sixteen inch increments along a wall section, such as the wall section having the track 802, for example. Accordingly, the frame guide 816, the frame guide 818, the frame guide 822, and the frame guide 824 may be used as the measurement guides for placement of the stud 810, the stud 808, the stud 806, and the stud 804.

In an illustrative embodiment, the stud 804 may be positioned first, plumbed using the framing tool 814, and secured to the track 802. The framing tool 814 may be positioned with the frame guide 824 against the stud 804, such that a portion of the frame guide 824 that creates a ninety degree angle between the frame guide 824 and the base of the framing tool 814 is flush against one side of the stud 804, for example. One or more coupling mechanisms along the top of the framing tool 814, such as the coupling mechanism 414 and the coupling mechanism 416 in FIG. 4, may provide a temporary, secure connection between the framing tool 814 and the track 802 to hold the framing tool 814 securely and evenly against the track 802, in this illustrative example.

The stud 806, the stud 808, and the stud 810 may each be positioned along the track 802 using the frame guide 822, the frame guide 818, and the frame guide 816, respectively, to provide a sixteen inch increment of space between each stud along the track 802. The stud 806, the stud 808, and the stud 810 may be temporarily held in place within the track 802 by a coupling between each of the studs 806, 808, and 810 and the frame guides 822, 818, and 816, respectively. For example, in one illustrative embodiment where the stud 806, the stud 808, and the stud 810 are metal studs, the coupling mechanism implemented on each of the frame guide 822, the frame guide 818, and the frame guide 816 may be one or more magnetic strips, providing a magnetic attraction between the studs and the frame guides. Each of the studs may be secured to the track 802 while the framing tool 814 is positioned against the track 802 and holds the studs in alignment, providing for the placement and securement of multiple studs as the framing tool 814 remains in position. The framing tool 814 may then be removed from position against the track 802 along the stud 804, the stud 806, the stud 808, and the stud 810, and repositioned with the frame guide 824 against the track 802 and the stud 810, in order to place and secure additional studs, such as the stud 812 and/or any other number of studs, for example.

The illustration of the framing environment 800 in FIG. 8 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 9:
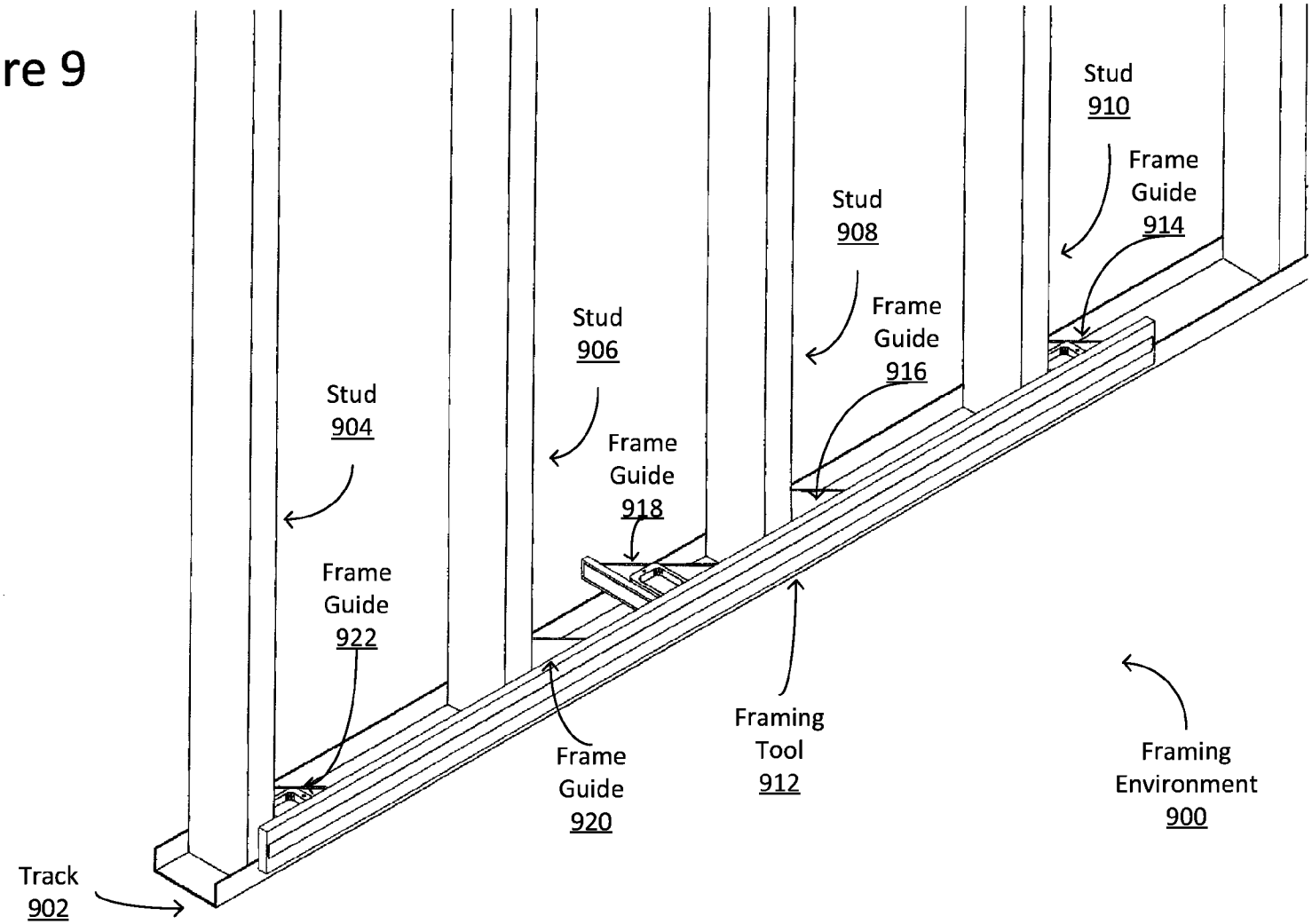
FIG. 9 is an illustrative example of a framing environment in accordance with an advantageous example embodiment.

With reference now to FIG. 9, an illustration of a framing environment is depicted in which an advantageous example embodiment may be implemented. The framing environment 900 may include an implementation of a framing tool, such as the framing tool 100 in FIG. 1, for example. The framing environment 900 may be an illustrative example of one implementation of the framing environment 800, depicting the framing tool 814 as described when the top of the framing tool 814 is positioned flush against the track 802 along the floor, for example.

The framing environment 900 includes a track 902. The track 902 may be an illustrative implementation of the track 802 in FIG. 8, for example. A stud 904, a stud 906, a stud 908, and a stud 910, may be aligned and affixed to the track 902 using the framing tool 912, in this illustrative example. The framing tool 912 may include one or more coupling mechanisms along the top of the framing tool 912 (not shown), such as the coupling mechanism 120 and the coupling mechanism 122 in FIG. 1, for example, used to temporarily secure the framing tool 912 to the track 902 along the floor of a structure to be framed.

The framing tool 912 includes a frame guide 914, a frame guide 916, a frame guide 918, a frame guide 920, and a frame guide 922. In this illustrative example, the specifications for the framing environment 900 may require studs to be placed at sixteen inch increments along a wall section, such as the wall section having the track 902, for example, as similarly described in the framing environment 800. Accordingly, the frame guide 914 may be used to position and align the stud 910, the frame guide 916 may be used to position and align the stud 908, the frame guide 920 may be used to position and align the stud 906, and the frame guide 922 may be used to position and align the stud 904. The frame guide 918 may or may not be used in this illustrative example.

In this illustrative embodiment, the stud 904 may be positioned first, plumbed using the framing tool 912, and secured to the track 902. The framing tool 912 may be positioned with the frame guide 922 against the stud 904 and the track 902 in order to place and secure the stud 906, the stud 908, and the stud 910 using the framing tool 912.

The illustration of the framing environment 900 in FIG. 9 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 10:
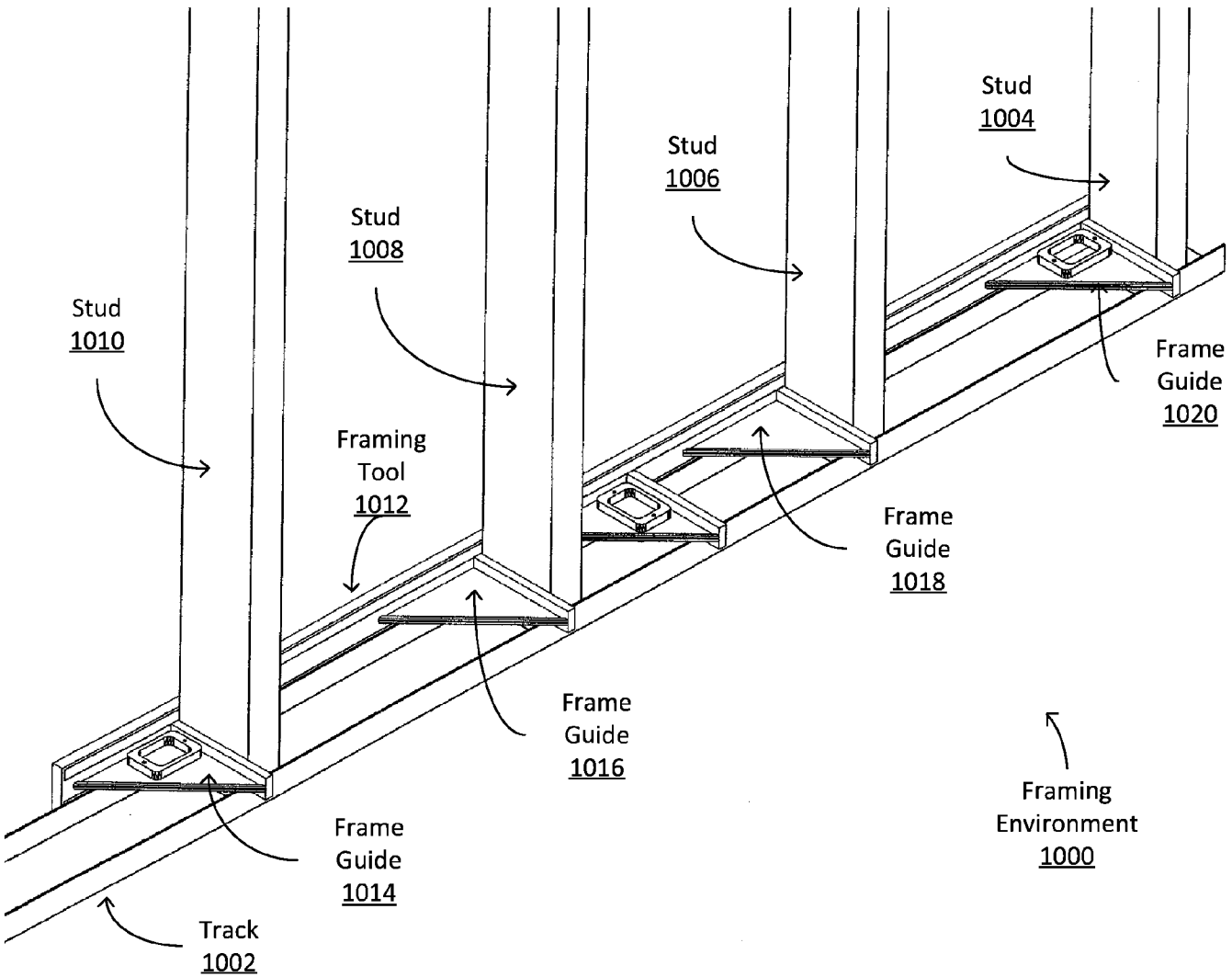
FIG. 10 is an illustrative example of a framing environment in accordance with an advantageous example embodiment.

With reference now to FIG. 10, an illustration of a framing environment is depicted in which an advantageous example embodiment may be implemented. The framing environment 1000 may include an implementation of a framing tool, such as the framing tool 100 in FIG. 1, for example. The framing environment 1000 may be an illustrative example of one implementation of the framing environment 800, depicting the framing tool 814 as described when the top of the framing tool 814 is positioned flush against the track 802 along the floor, for example.

The framing environment 1000 includes a track 1002. The track 1002 may be an illustrative implementation of the track 802 in FIG. 8, for example. A stud 1004, a stud 1006, a stud 1008, and a stud 1010, may be aligned and secured to the track 1002 using the framing tool 1012, in this illustrative example.

The framing tool 1012 includes a plurality of frame guides. In this illustrative example, the specifications for the framing environment 900 may require studs to be placed at sixteen inch increments along a wall section, such as the wall section having the track 1002, for example, as similarly described in the framing environment 800. Accordingly, the frame guide 1014 may be used to position and align the stud 1010, the frame guide 1016 may be used to position and align the stud 1008, the frame guide 1018 may be used to position and align the stud 1006, and the frame guide 1020 may be used to position and align the stud 1004.

In this illustrative embodiment, the stud 1004 may be positioned first, plumbed using the framing tool 1012, and secured to the track 1002. The framing tool 1012 may be positioned with the frame guide 1020 against the stud 1004 and the track 1002 in order to place and secure the stud 1006, the stud 1008, and the stud 1010 using the framing tool 1012.

The illustration of the framing environment 1000 in FIG. 10 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

Figure 11:
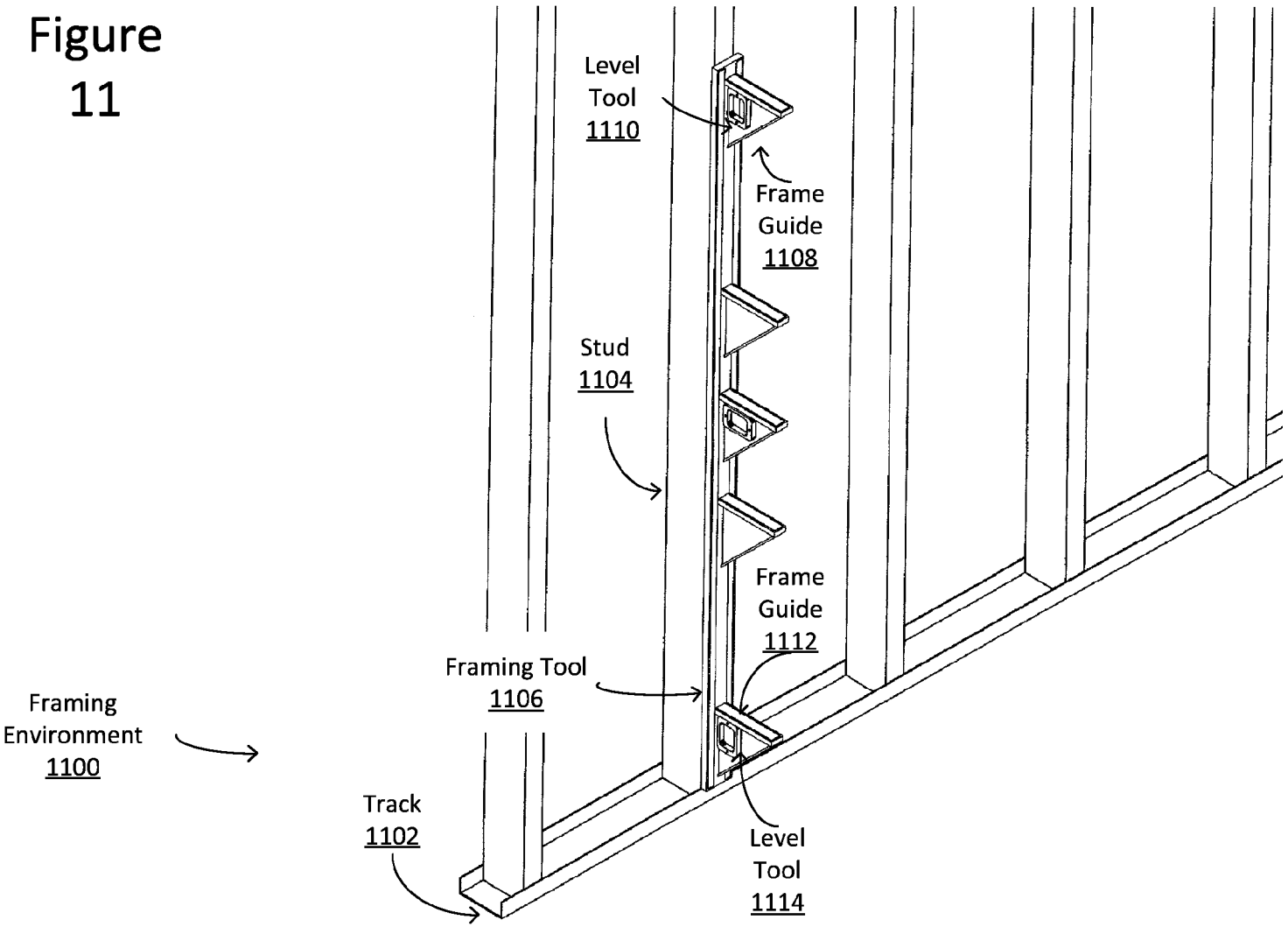
FIG. 11 is an illustrative example of a framing environment in accordance with an advantageous example embodiment.

With reference now to FIG. 11, an illustration of a framing environment is depicted in which an advantageous example embodiment may be implemented. The framing environment 1100 may include an implementation of a framing tool, such as the framing tool 100 in FIG. 1, for example. The framing environment 1100 may be an illustrative example of one implementation of the framing environment 800, depicting the framing tool 814 as described when the bottom of the framing tool 814 is positioned flush against the stud 804 in a vertical alignment used to plumb the stud 804, for example.

In this illustrative embodiment, the track 1102 is secured along a floor of a structure where a wall section is to be framed. The track 1102 may be a metal plate or metal tray used along the bottom and/or top of a wall section, for example. A stud 1104 may be placed in the track 1102 as the first stud in a series of studs for the wall section to be framed. A framing tool 1106 may be placed vertically against the length of the stud 1104. The framing tool 1106 may include a coupling mechanism along the bottom of the framing tool 1104, such as the coupling mechanism 504 in FIG. 5, for example. The coupling mechanism (not shown) may temporarily couple the framing tool 1104 with the stud 1104 to hold the framing tool 1104 in place against the stud 1104 without need of additional tools and/or support.

The framing tool 1106 may include a plurality of frame guides. A frame guide 1108 at one end of the framing tool 1106 may include a level tool 1110. The level tool 1110 may be any suitable device known in the industry for establishing a plane, such as, without limitation, a bubble level for example. A frame guide 1112 at the opposite end of the framing tool 1106 from the frame guide 1108 may include a level tool 1114, similar to that of the level tool 1110. The level tool 1110 and the level tool 1114 may be used to plumb the stud 1104 in this illustrative example, when the stud 1104 is the first stud for the wall section along the track 1102.

The illustration of the framing environment 1100 in FIG. 11 is not meant to imply physical or architectural limitations to the manner in which different advantageous embodiments may be implemented. Other components in addition and/or in place of the ones illustrated may be used. Some components may be unnecessary in some advantageous embodiments. Also, the elements are presented to illustrate some functional components. One or more of these elements may be combined and/or divided into different elements when implemented in different advantageous embodiments.

The illustrations in the different depicted embodiments illustrate example architecture, functionality, and operation of some possible implementations of tools and methods. In some alternative implementations, the function or functions noted in the flow diagrams may occur out of the order noted in the figures. For example, in some cases, two blocks shown in succession may be executed substantially concurrently, or the blocks may sometimes be executed in the reverse order, depending upon the functionality involved.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

CONCLUSION

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. An apparatus comprising:

a plurality of frame guides positioned along a base, wherein each of the plurality of frame guides is substantially configured to provide a ninety degree angle with the base on at least one side of the each of the plurality of frame guides; and a plurality of magnetic coupling mechanisms secured to a top portion and a bottom portion of the base and configured to temporarily secure the base to at least one track.

2. The apparatus of claim 1 wherein the plurality of magnetic coupling mechanisms are further configured to temporarily secure the base along a horizontal plane of the at least one track.

3. The apparatus of claim 1 wherein the plurality of magnetic coupling mechanisms include a first magnetic strip disposed along a bottom of the base, a second magnetic strip and a third magnetic strip disposed along a top of the base, and wherein the second magnetic strip is disposed along the top of the base to a first side of the plurality of frame guides, and wherein the third magnetic strip is disposed along the top of the base to a second side of the plurality of frame guides.

4. The apparatus of claim 1 wherein the plurality of magnetic coupling mechanisms include a magnetic strip disposed along a front portion of the each of the plurality of frame guides.

5. The apparatus of claim 1 wherein the plurality of magnetic coupling mechanisms are configured to provide a connection between the apparatus and one or more construction materials.

6. The apparatus of claim 1 wherein the plurality of magnetic coupling mechanisms are further configured to temporarily secure the base vertically between a first track and a second track.

7. The apparatus of claim 1, further comprising:

one or more level tools disposed within one or more of the plurality of frame guides.

8. The apparatus of claim 1 wherein each frame guide is located at a discrete distance from another frame guide.

9. The apparatus of claim 1 wherein the plurality of frame guides are positioned to provide at least one of a sixteen inch spacing measured between each front of the plurality of frame guides or a twenty-four inch spacing measured between each front of the plurality of frame guides.

10. The apparatus of claim 1 wherein the base comprises aluminum.

11. The apparatus of claim 1 wherein at least one of the plurality of frame guides comprises aluminum.

12. A method for stud placement in framing, the method comprising:

positioning a plurality of frame guides along a base of a framing tool;

securing the plurality of frame guides to the base of the framing tool;

securing at least two magnetic coupling mechanisms to the base of the framing tool, wherein at least one magnetic coupling mechanism is disposed along a top surface of the base, and wherein at least one other magnetic coupling mechanism is disposed along a bottom surface of the base; and securing at least one level tool to at least one frame guide in the plurality of frame guides.

13. The method of claim 12 wherein positioning the plurality of frame guides comprises locating each of the plurality of frame guides along the base to substantially provide a ninety degree angle on at least one side of the each of the plurality of frame guides.

14. The method of claim 12 further comprising:

securing at least one coupling mechanism to at least one of the plurality of frame guides.

15. A framing tool comprising:

a plurality of frame guides positioned along a base, wherein each of the plurality of frame guides is substantially configured to provide a ninety degree angle on at least one side of the each of the plurality of frame guides;

a first magnetic coupling mechanism secured along a bottom portion of the base;

a second magnetic coupling mechanism secured along a top portion of the base;

at least one magnetic coupling mechanism secured along each of the plurality of frame guides; and at least one level tool secured to at least one frame guide of the plurality of frame guides.

16. The framing tool of claim 15 wherein the at least one level tool is positioned within the at least one frame guide.

17. The framing tool of claim 15 wherein the first magnetic coupling mechanism is configured to provide temporary attachment between the framing tool and two or more tracks when the framing tool is in a vertical position.

18. The framing tool of claim 15 wherein the plurality of frame guides are positioned to provide at least one of a sixteen inch spacing measured between each front of the plurality of frame guides or a twenty-four inch spacing measured between each front of the plurality of frame guides.

19. The framing tool of claim 15 wherein the second magnetic coupling mechanism is configured to provide temporary attachment between the framing tool and at least one track when the framing tool is in a vertical position.

20. The framing tool of claim 15 wherein the at least one magnetic coupling mechanism secured along each of the plurality of frame guides is configured to provide temporary attachment between the framing tool and one or more metal studs.

* * * * *